United States Patent [19]

Krasser et al.

[11] Patent Number: 4,540,864

[45] Date of Patent: Sep. 10, 1985

[54] ACTUATING FIXTURE FOR PUSH-PULL SWITCH

[75] Inventors: Fritz Krasser; Josef Peter, both of Altdorf, Fed. Rep. of Germany

[73] Assignee: Ellenberger & Poensgen GmbH, Altdorf, Fed. Rep. of Germany

[21] Appl. No.: 543,515

[22] Filed: Oct. 18, 1983

[30] Foreign Application Priority Data

Nov. 11, 1982 [DE] Fed. Rep. of Germany ..... 3241677

[51] Int. Cl.[3] ..... H01H 13/06

[52] U.S. Cl. ..... 200/302.2; 200/307; 200/340

[58] Field of Search ..... 200/302.2, 307, 330, 200/331, 338, 340

[56] References Cited

U.S. PATENT DOCUMENTS

| | | | |
|---|---|---|---|
| 2,523,125 | 9/1950 | Ley | 200/340 |
| 3,231,706 | 1/1966 | Waldorf | 200/302.2 |
| 3,541,288 | 11/1970 | Maas | 200/302.2 |

FOREIGN PATENT DOCUMENTS

| | | | |
|---|---|---|---|
| 1980282 | 3/1968 | Fed. Rep. of Germany . | |
| 1558875 | 2/1969 | France | 200/340 |

*Primary Examiner*—Stephen Marcus
*Assistant Examiner*—Renee S. Kidorf
*Attorney, Agent, or Firm*—Spencer & Frank

[57] ABSTRACT

An actuating fixture for use with a push-pull switch comprises a push-pull button through which a tightening screw extends axially, and a clamping tongs which can be closed by the screw. In its operational end position, the tongs grips an actuating head of the switch below an annular flange of the head. The push-pull button projects from a collar portion of a protective housing, and the collar portion and a casing of the switch bear external threadings which are both of the same type and diameter. The push-pull button is connected with the end of the protective housing facing toward the switch by means of an encasing hose of water-tight, flexible material. The actuating fixture has an internal threading which can be screwed on to the aforesaid external threading of the switch casing. The actuating fixture can then be affixed in a switchboard by means of the aforesaid external threading of the collar portion in the same manner as the switch casing could be affixed in the switchboard by means of the said external threading of the switch casing.

10 Claims, 3 Drawing Figures

ACTUATING FIXTURE FOR PUSH-PULL SWITCH

BACKGROUND OF THE INVENTION

This invention relates to an actuating fixture for a push-pull switch, in particular for a protective circuit breaker for on-board power supply means, which switch comprises a switch casing having a frontal face, an actuating head protruding from the said frontal face, an externally threaded annular flange of said casing extending axially outwardly therefrom and surrounding the actuating head and adapted for mounting of the switch on a switchboard or the like panel, a push-pull button having an inner guiding end part facing toward the said switch casing and clamping tong means adapted for clamping connection with the said actuating head. A push-pull switch of this type is described in German Gebrauchsmuster No. 1,980,282.

The known actuating fixture is devised as a push-pull knob and can be mounted on an actuating head of a push-pull switch after the manufacture of the said head. Its push-pull knob is of a configuration facilitating its being gripped by a glove-covered hand more easily than the previously known actuating head of this kind of switch. It is customary to mount the known push-pull switches, and in particular protective circuit breakers for on-board power supply means, in a plural arrangement next to one another behind an instrument board; and an annular flange of each head, being provided with an external threading, extends through a bore in the switchboard. Mounting in the switchboard is effected by a retaining nut which is screwed on to the end of the externally threaded flange which protrudes out of the switchboard.

OBJECTS AND BACKGROUND OF THE INVENTION

The invention is to solve the problem of providing an actuating fixture of the initially described type which permits a water-tight assembly of a push-pull switch in a conventional switchboard.

This object and others which will become apparent from the further description of the invention, are attained by an actuating fixture of the initially described type which comprises further

- a protective housing, in which the said push-pull button is axially displaceably lodged and which surrounds the inward button end part;
- the said protective housing comprising a collar portion, from which the push-pull button protrudes outwardly, and an end portion facing inwardly toward the switch casing, and bearing an internal threading adapted for being threaded on to the externally threaded flange of the switch casing;
- an encasing hose of water-tight flexible material which hose connects the inner guiding end part of the push-pull button with the inwardly facing end portion of the protective housing in a water-tight manner, and surrounds an internal space for housing the actuating head, and
- the collar portion of the protective housing has an external threading, the type and diameter of which are the same as those of the internal threading of the inward end portion of the protective housing.

Owing to the aforesaid novel feature, the actuating fixture according to the invention can be mounted in the same mounting aperture of the switchboard which is dimensioned for the direct mounting therein of the switch, by means of a lock nut which latter can be, in particular, the nut of the switch itself. By providing an actuating end of the push-pull button having the same contours as those of the actuating head of the switch, the user will not see any difference from a conventionally built-in switch. As a building unit, the push-pull button together with its protective housing and the parts guaranteeing water-tightness can be pre-assembled in the factory, and is already water-tight. The user can also build this building unit subsequently into a switchboard without altering the aspect of the indicating and actuating face of the latter.

According to a preferred embodiment of the invention, the wall of the encasing hose comprises at least one bellows type fold, thereby affording a long-lasting configuration of the hose.

Preferably, the inner end, turned toward the circuit breaker casing, of the hose is clamped in between an annular rib projecting radially inwardly from the inner wall surface of the protective housing and an annular nut being sealingly set in the protective housing, constituting the said inward end portion thereof and containing the said internal threading of said portion. Thereby, a water-tight connection between the encasing hose and the protective housing can be established in a simple manner, favorable for manufacturing techniques. The same is true with regard to the connection between the encasing hose and the push-pull button, by crimping the hose with its outward open end in a positive manner over the periphery of the inner end part of the push-pull button.

It is known from the prior art how to affix the push-pull button on the actuating head of the switch.

In a preferred embodiment of the actuating fixture according to the invention, the clamping tong means can be rigged on the push-pull button by means of a tightening screw which extends axially through the inner, screw-guiding end part of the push-pull button and which can pull the clamping tong means into fixed contact with the sidewall of a cavity in the inner end part of the push-pull button, the said push-pull button consisting of the said inner end part and an outer actuating part which parts are fitted together in axial alignment and which can be braced together by means of the said tightening screw.

Preferably a sealing ring surrounds the tightening screw as a packing and is located between the inner end part and the actuating part of the push-pull button.

This guarantees a water-tight lodging of the tigthening screw in the push-pull button, without impairing access to the tightening screw from the outside for the purpose of tightening or loosening the same.

A bore extends axially through the inner end part of the push-pull button for receiving the tightening screw. An axial bore in the actuating part of the pull-push button is provided to register with the first-mentioned bore and is adapted to receive the head of the tightening screw, the bolt part of which extends inwardly through the inner end part of the button and inwardly out of the latter into the said cavity.

The water-tightness of this type of mounting the tightening screw is further improved by providing a conically inwardly tapered seat about the upper end of the tightening screw-receiving bore in the upper frontal end face of the inner end part of the pull-push button, which frontal end face is turned toward the actuating part of the button.

In the upper frontal end face of the button actuating part a recess, of wider diameter than the above-mentioned bore, can be provided for housing a tightening screw head therein whose diameter is larger than that of the screw bolt. This recess can be closed in a water-tight manner by inserting a cap sealingly in the same.

It thus becomes possible in a simple manner to impart to the actuating end of the push-pull button the same aspect as is shown by the actuating head of a conventional push-pull switch, in particular that of a protective circuit breaker of an on-board power supply, without impairing the possibility of turning the tightening screw.

A water-tight sealing of the bore in the switch board for receiving therein the external threaded collar portion of the protective housing of a push-pull button can be achieved advantageously by the following features in a preferred embodiment of the actuating fixture according to the invention.

The collar portion of the protective push-pull button housing preferably comprises an annular flange devised as a sealing ring and having a larger diameter than the collar portion. This sealing ring preferably has a flat sealing face, turned away from the actuating head of the switch, and contains an annular groove therein about the foot end of the collar portion where the latter merges with the upper, outward portion of the protective housing for the push-pull button.

Fastening of this protective housing, together with the switch mounted thereon, can take place in a conventional manner by means of a ring nut which is screwed down on the collar portion. This is preferably the same nut that was previously used to hold the switch in position in the switchboard.

The actuating fixture according to the invention can be used advantageously, for instance, for rendering water-tight switches such as a circuit breaker for the on-board power supply in the switchboard of a speedboat or the like vessel, in the operation of which water may splash on to the switchboard.

BRIEF DESCRIPTION OF THE DRAWINGS

Further details of the invention and other objects and advantages thereof will become apparent from the following description thereof having reference to the accompanying drawings in which.

DETAILED DESCRIPTION OF THE EMBODIMENT SHOWN IN THE DRAWINGS

Figure 2:
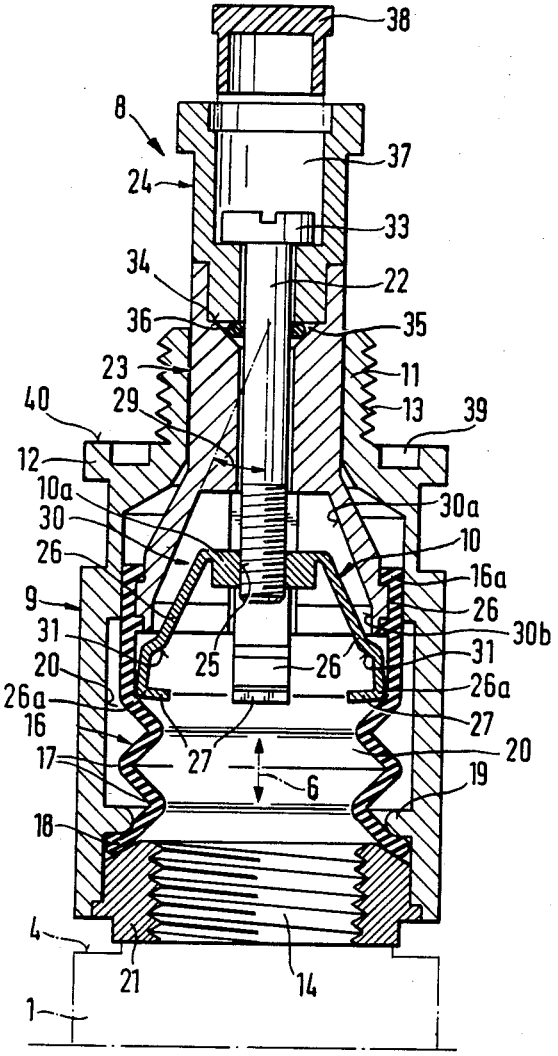
FIG. 2 is a longitudinal sectional view of the actuating fixture according to the invention, in the embodiment shown in FIG. 1, in its position as resulting from manufacture and ready to be mounted on a conventional circuit breaker or the like switch in a switchboard.
Figure 3:
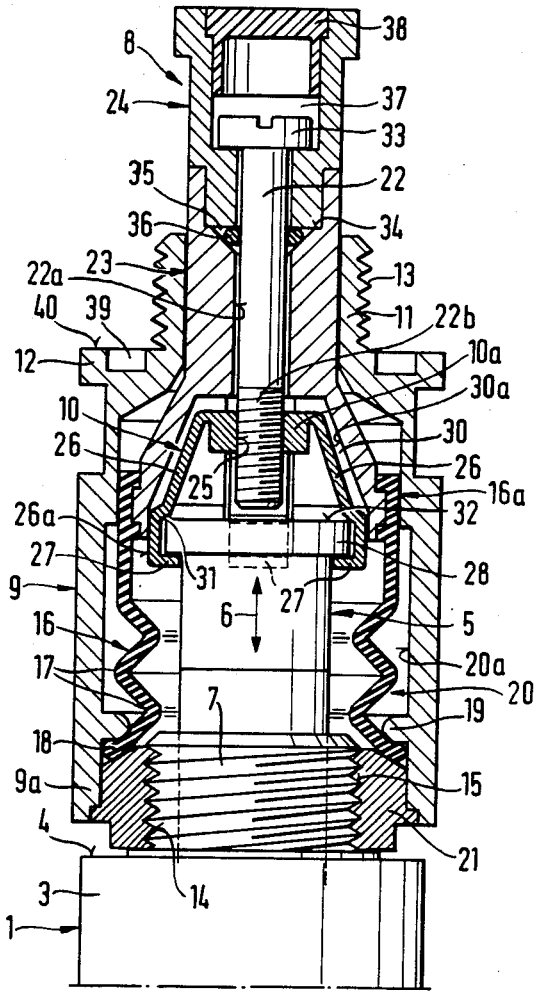
FIG. 3 shows a similar view of the embodiment of a actuating fixture as FIG. 2, but assembled in final position, by connection with the actuating head and the casing of a switch.

The actuating fixture according to the invention, a preferred embodiment of which is shown in FIGS. 2 and 3 in longitudinal sectional view, is destined to serve for mounting, in a water-tight manner, a protective circuit breaker for on-board power supply means, referred to hereinafter briefly as the "switch" 1, in a switchboard or dashboard 2. An actuating head 5 protrudes upwardly, i.e. in outward axial direction, away from the switch 1, from an upper frontal end face 4 of a switch casing 3, and can be pushed or pulled in axial direction as indicated by the arrows 6, thereby actuating the switch. The actuating head 5 of the switch 1 is surrounded by an annular flange 7 provided with an external threading 15, and protrudes, together with this flange 7, through a switchboard bore or opening **2*a* toward the outside, when the protective casing is directly mounted on the inner side or underside 2*b* of a switchboard 2**.

Hitherto, fastening in position in the switchboard 2 was effected by means of a retaining nut (not shown) which had to be screwed from the outside on to the outwardly protruding externally threaded part of the flange 7. The switchboard 2 would then be clamped in between the said annular nut and the frontal end face 4 of the casing 3.

Figure 1:
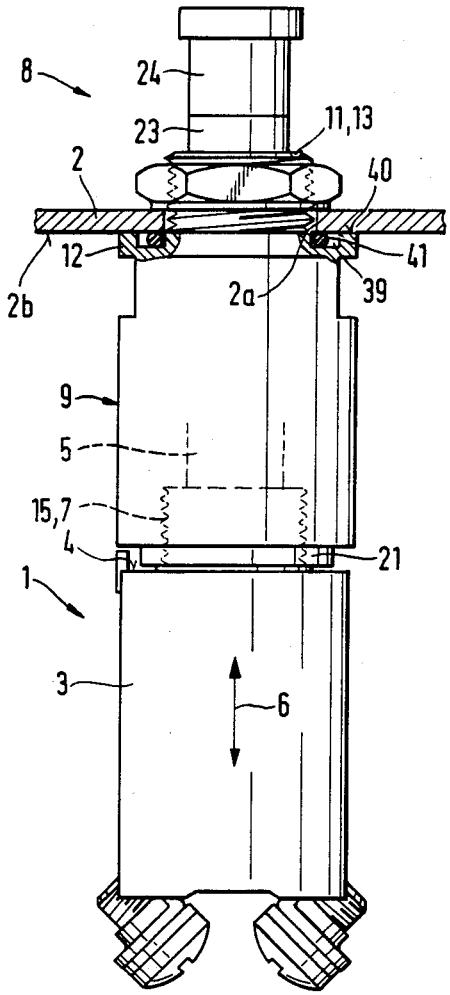
FIG. 1 is an overview, partly in section, of a preferred embodiment of the water-tight actuating fixture and of a protective circuit breaker, joined together, for an on-board power supply, which fixture is mounted in a switchboard.

This mode of fastening the switch 1 on the switchboard, which did not turn out to be sufficiently water-tight, is replaced, in accordance with the invention, by the use of the actuating fixture according to the invention, which use comprises fastening in the opening **2*a* of the switchboard 2 the actuating fixture to which the switch actuating head 5 and casing are in turn attached in position underneath the switchboard 2 (FIG. 1**).

The push-pull button 8 is lodged in its protective housing 9 displaceably in upward or downward axial direction as indicated by the arrows 6. It comprises, at its inner end part facing toward the switch 1 a clamping tongs 10 which can be moved toward closing position so as to grip with bias the actuating head 5 of the switch 1.

The push-pull button 8 is axially displaceably supported in the collar portion 11 which is molded integrally with the annular flange 12 which bears the frontal end face of the protective housing 9. The collar portion 11 is provided with an external threading 13 which has the same type of threading, i.e. metric, Whitworth or the like, and diameter as the external threading 15 of the annular flange 7 of the switch 1.

The protective casing 9, which consists of synthetic resin or of metal as do other parts of the actuating fixture, contains in its end portion turned toward the switch 1 a cavity 30 adapted for receiving therein the actuating head 5 of the switch 1.

In this cavity 30, there is arranged an encasing hose 16 of water-tight, flexible material such as rubber or elastically resilient synthetic resin, which hose 16 is coaxially disposed with, and deformable in, an axial direction indicated by the arrows 6. This encasing hose 16 is connected water-tight, at its end portion **16*a* turned away from the switch 1, with the push-pull button 1**.

The fastening of the encasing hose 16 with its end portion **16*a* at the push-pull button 8 is effected by positive gripping about the periphery of the latter in order to guarantee a satisfactory seal. The end portion 18 of the encasing hose 16, facing toward the switch 1, is connected water-tight with the circumferential wall of the protective housing 9. To this end, the end portion 18 of the encasing hose 16 is clamped in between an annular inwardly projecting shoulder 19 molded integrally with the inner wall 20*a* of the protective housing 9, on the one hand, and an annular nut 21, on the other hand, which nut 21 contains the internal threading 14 and is affixed water-tight in the inward end portion 9***a*, facing toward the switch 1, of the protective housing 9.

The encasing hose 16 surrounds a receiving space 20 for the actuating head 5. The tubular wall of the encasing hose 16 is shaped to form one or several folds 17 as in a bellows.

The push-pull button 8 consists of a guiding part 23 comprising the inner end part facing toward the switch 1, and of the actuating part 24 which faces away from the switch 1; the button 8 is provided with a central longitudinal bore 22*a* adapted for housing a tightening screw 22. The guiding part 23 and the actuating part 24 are aligned with each other in axial direction and joined together. The tightening screw 22, which extends through the actuating part 24 and the guiding part 23, has an externally threaded end portion 22*b* which is screwed into the internal threading 25 provided in a central top piece 10*a* of a clamping tongs 10 which comprises four tongs arms 26 which project from the center piece 10, radially outwardly biassed, and slanted downwardly toward the switch 1. Only three of these arms 26 are visible in FIGS. 2 and 3. In their downwardly extending portions the arms 26 are angularly bent to extend outwardly, to result in a less steeply conical annular zone 31, and then downwardly to extend in almost axial direction, and at their free ends 26*a* they bear radially inwardly bent jaws 27 which are thus adapted to engage the actuating head 5 of the switch 1 in operating position by projecting inwardly underneath an annular flange 28 radially projecting from the top end of the actuating head 5, thereby firmly gripping the latter.

By turning the tightening srew 22, the clamping tongs 10 can be moved upwardly into the interior of the cavity 30 or downwardly out of the latter.

The arms 26 of the clamping tongs 10 lie within the cavity 30 which is delimited by a conically tapered inner sidewall 30*a*. The latter is inclined under an acute angle 29 with regard to the central longitudinal axis of the push-pull button 8. At its lower periphery, turned toward the switch 1, the conically tapered sidewall 30*a* merges with a cylindrical sidewall zone 30*b*.

In FIG. 2, the clamping tongs 10 is shown in open position, resting with radial outward bias with its lowermost arm ends 26*a* against the inner side of the encasing hose 16. In this position, the actuating head 5 of a switch 1 can be introduced into the interior 20 of the encasing hose 16 until its top end flange 28 is entirely at a level above the spread apart tong jaws 27 (FIG. 2).

The clamping tongs 10 is then tensioned by turning the tightening screw to raise the tongs 10 upwardly into the interior of the cavity 30. By doing so, the outer conically inclined surfaces of the tongs arms 26 abut against the lower periphery of the cylindrical sidewall zone 30*b* of the guiding part 23 and are thereby forced to swing inwardly as they slide upwardly on that sidewall zone periphery, thereby closing the jaws 27 at their ends, to firmly grip the actuating head 5 below the flange 28 of the latter, and move the same axially upwardly until the lower arm portions now define a cylindrical configuration and rest with their lower ends 26*a* firmly against the cylindrical sidewall zone 30*b*. Moreover, the arms 26 come to rest with their bent zones 31 against the top end face 32 of the actuating head 5 of the switch 1. Thus, tightening of the tightening screw 22 not only results in closing the clamping tongs 10 below the top end flange 28 of the actuating head 5, but also, due to the head 33 of the tightening screw 22 coming to rest on the bottom of a recess 37 in the actuating part 24 of the push-pull button 8, in an axial bracing of the guiding part 23 with the actuating part 24 of the push-pull button 8.

The frontal face 34 of the guiding part 23, which is turned toward the actuating part 24, is provided with an internal conically sloped recess 35, in which there is housed a sealing ring 36 which surrounds the tightening screw 22 like a gland, and thus provides for a water-tight support of the tightening screw 22 in the push-pull button 8.

In the range of the free frontal face of the actuating part 24 of the push-pull button 8, there is provided the above-mentioned recess 37 which can be closed off from the outside by means of a covering cap 38 which can be inserted into the recess 37 in a water-tight manner.

The collar portion 11 protrudes upwardly from the annular flange 12 which bears in an annular groove 39, provided in the annular sealing surface 40 of the annular flange 12, a sealing ring 41 having a larger diameter than the collar portion 11.

In order to achieve a water-tight joint between the actuating fixture and the switch 1, the protective housing 9, with the clamping tongs 10 therein in open position, is screwed, by means of its internal threading 14, on to the external threading of the annular flange 7 of the switch 1. The clamping tongs 10 is then closed by tightening the tightening screw 22, whereby it grips the actuating head 5 of the switch 1 just below its top end flange 28. Simultaneously, the guiding part 23 and the actuating part 24 of the push-pull button 8 are thereby braced axially, with the sealing ring sealingly surrounding the tightening screw 22.

By actuation of the push-pull button 8, pushing or pulling the same in an axial direction as indicated by the arrows 6, a relative displacement of the button 8 is effected with regard to the housing 9 and the stationary switch 1. The encasing hose 16 is thereby expanded or compressed, as the case may be, in the same axial direction (arrows 6) with the deformation of the hose 16 being facilitated by its bellows-shaped configuration.

Terms such as "upper", "lower", "inner", "outer", "inward", "outward" and similar terms refer to the position of the respective parts in the accompanying drawings.

We claim:

1. An actuating fixture for a push-pull switch, in particular for a protective circuit breaker for on-board power supply means, which switch comprises a switch casing having a frontal face, an actuating head protruding from said frontal face, an externally threaded annular flange of said casing extending axially outwardly therefrom and serving the mounting said switch on a switchboard or the like panel; and which actuating fixture comprises (a) a push-pull button having an inner guiding end part facing toward said switch casing;

(b) clamping tong means adapted for clamping connection with said actuating head;

(c) a protective housing, in which said push-pull button is axially displaceably lodged, said protective housing having an inwardly facing end portion, turned toward said switch, and surrounding said inward button end part;

(d) said protective housing comprising a collar portion, from which said push-pull button protrudes outwardly, and said inwardly facing end portion of said protective housing bearing an internal threading adapted for being threaded on to said externally threaded flange of said switch casing;

(e) an encasing hose of water-tight flexible material which hose connects said inner guiding end part of said push-pull button with the inwardly facing end portion of said protective housing in a water-tight manner, said encasing hose surrounding an internal space for housing the actuating head;

(f) said collar portion of said protective housing having an external threading, the type and diameter of which are the same as those of the internal threading of the inward end portion of said protective housing; and (g) said encasing hose having a first open end thereof turned toward said switch, said protective housing having an inner wall surface and comprising an annular rib projecting radially inwardly from said inner housing wall, and an internally threaded annular nut sealingly set in said protective housing so as to constitute said inwardly facing end portion, said first encasing hose end being clamped in between said rib and said nut.

2. The actuating fixture of claim 1, wherein said encasing hose has a wall comprising at least one bellows-type fold.

3. The actuating fixture of claim 1, wherein said encasing hose has a second, outward open end crimped positively over the periphery of said inner guiding end part of said push-pull button.

4. The actuating fixture of claim 3, wherein said encasing hose has a wall comprising at least one bellows-type fold.

5. An actuating fixture for a push-pull switch, in particular for a protective circuit breaker for on-board power supply means, which switch comprises a switch casing having a frontal face, an actuating head protruding from said frontal face, an externally threaded annular flange of said casing extending axially outwardly therefrom and serving for mounting said switch on a switchboard or the like panel; and which actuating fixture comprises (a) a push-pull button having an inner guiding end part facing toward said switch casing;

(b) clamping tong means adapted for clamping connection with said actuating head;

(c) a protecting housing, in which said push-pull button ia axially displaceably lodged, said protective housing having an inwardly facing end portion, turned toward said switch, and surrounding said inward button end part;

(d) said protective housing comprising a collar portion, from which said push-pull button protrudes outwardly, and said inwardly facing end portion of said protective housing bearing an internal threading adapted for being threaded on to said externally threaded flange of said switch casing;

(e) an encasing hose of water-tight flexible material which hose connects said inner guiding end part of said push-pull button with the inwardly facing end portion of said protective housing in a water-tight manner, said encasing hose surrounding an internal space four housing the actuating head;

(f) said collar portion of said protective housing having an external threading, the type and diameter of which are the same as those of the internal threading of the inward end portion of said protective housing; and (g) said push-pull button comprising an outer actuating part aligned with and joined to an outer end of said inner guiding part thereof, an axial bore through said outer actuating part and said inner guiding part of said push-pull button, and a tightening screw lodged in said bore and extending inwardly out of said guiding part and engaging said clamping tong means.

6. The actuating fixture of claim 5, wherein said outer actuating part of said push-pull button has a frontal end face, turned away from said switch, and a recess in said frontal actuating part end face, said recess having a larger diameter than said bore.

7. The actuating fixture of claim 5, wherein said inner guiding part of said push-pull button comprises a cavity opening toward said switch, and said tightening screw so engages said clamping tong means that tightening of said screw moves said clamping tong means toward the interior of said cavity and braces said inner guiding part and said outer actuating part of said push-pull button together.

8. The actuating fixture of claim 7, wherein said push-pull button comprises a cap which sealingly fits into said recess whereby said recess can be closed off in a water-tight manner.

9. The actuating fixture of claim 7, wherein said push-pull button comprises a sealing ring surrounding said tightening screw between the inner guiding end part and the actuating part of said push-pull button.

10. The actuating fixture of claim 9, wherein said bore has an orifice in said inner guiding end part of said push-pull button, on the face of said guiding end part turned toward said outer actuating part, and a conically inwardly tapered seat about said bore orifice, said sealing ring resting on said conically inwardly tapered seat.

* * * * *